US005810561A

United States Patent [19]

Cossette

[11] Patent Number: 5,810,561

[45] Date of Patent: Sep. 22, 1998

[54] VARIABLE PITCH PROPELLER APPARATUS

[76] Inventor: Thomas C. Cossette, 13588 67th Pl. North, Maple Grove, Minn. 55311

[21] Appl. No.: 839,924

[22] Filed: Apr. 21, 1997

[51] Int. Cl.[6] ..... B63H 3/00

[52] U.S. Cl. ..... 416/43; 416/46; 416/153; 416/89

[58] Field of Search ..... 416/153, 136, 416/51, 44, 137, 139, 167

[56] References Cited

U.S. PATENT DOCUMENTS

| | | |
|---|---|---|
| 1,864,045 | 6/1932 | Kellogg et al. . |
| 2,005,343 | 6/1935 | Kent . |
| 2,243,046 | 5/1941 | Algarsson . |
| 2,282,426 | 5/1942 | Taylor . |
| 2,290,666 | 7/1942 | Ashelman . |
| 2,417,917 | 3/1947 | Everts . |
| 2,457,731 | 12/1948 | Roby . |
| 2,528,609 | 11/1950 | Rouse . |
| 2,559,767 | 7/1951 | Hatcher . |
| 2,574,951 | 11/1951 | Benson . |
| 2,638,171 | 5/1953 | Foss . |
| 2,681,632 | 6/1954 | Rossman . |
| 2,682,926 | 7/1954 | Evans . |
| 2,742,097 | 4/1956 | Gaston . |
| 2,850,106 | 9/1958 | Swan . |
| 2,949,966 | 8/1960 | Shimshauser . |
| 2,953,208 | 9/1960 | O'Connor . |
| 2,955,659 | 10/1960 | Daley . |
| 2,988,156 | 6/1961 | Coleman . |
| 2,998,080 | 8/1961 | Moore . |
| 3,009,321 | 7/1961 | Watts . |
| 3,145,780 | 8/1964 | Kean . |
| 3,177,948 | 4/1965 | Reid . |
| 3,229,772 | 1/1966 | Miller et al. . |
| 3,231,023 | 1/1966 | Marshall . |
| 3,275,083 | 9/1966 | Allin . |
| 3,295,610 | 1/1967 | Frias . |
| 3,302,725 | 2/1967 | Brimble et al. . |
| 3,308,889 | 3/1967 | Langhjelm et al. . |
| 3,403,735 | 10/1968 | Langhjelm et al. . |
| 3,567,336 | 3/1971 | Bartha . |
| 3,575,530 | 4/1971 | Hall . |
| 3,812,812 | 5/1974 | Hurwitz . |
| 3,853,427 | 12/1974 | Holt . |
| 4,297,079 | 10/1981 | Marshall . |
| 4,304,524 | 12/1981 | Coxon . |
| 4,419,050 | 12/1983 | Williams . |
| 4,599,043 | 7/1986 | Muller . |
| 4,744,727 | 5/1988 | Muller . |
| 4,792,279 | 12/1988 | Bergeron . |
| 4,842,483 | 6/1989 | Geary . |
| 4,897,056 | 1/1990 | Muller . |
| 4,929,153 | 5/1990 | Speer . |
| 4,929,201 | 5/1990 | Pitt . |
| 4,973,225 | 11/1990 | Kruppa . |
| 5,022,820 | 6/1991 | Bergeron . |
| 5,032,057 | 7/1991 | Speer . |
| 5,129,785 | 7/1992 | Speer . |
| 5,219,272 | 6/1993 | Steiner et al. . |
| 5,240,374 | 8/1993 | Speer . |
| 5,281,095 | 1/1994 | Komura et al. . |
| 5,290,147 | 3/1994 | Karls et al. . |
| 5,325,662 | 7/1994 | Varney et al. . |
| 5,326,223 | 7/1994 | Speer . |

(List continued on next page.)

*Primary Examiner*—Edward K. Look
*Assistant Examiner*—Richard Woo
*Attorney, Agent, or Firm*—Vidas, Arrett & Steinkraus

[57] ABSTRACT

A variable pitch propeller apparatus for use with a motor is disclosed. The apparatus includes a housing having a plurality of blades mounted therein for rotation. Adjustable high pitch and low pitch stop rings are connected to the housing and a synchronizer ring is slidably received by the housing and positioned between the stop rings. The synchronizer ring is limited in movement by the desired position of the adjustable high pitch stop ring and adjustable low pitch stop ring. A plurality of springs are used to bias the blades in a low pitch position for trolling and when the spring force is overcome by the thrust on the blades, the blades pivot to a high pitch position. The springs are cooperatively connected to the synchronizer ring or to the blades so that blade movement is coordinated and simultaneous. A tensioning ring is connected to the housing for simultaneously adjusting the tension on the springs.

21 Claims, 6 Drawing Sheets

U.S. PATENT DOCUMENTS 5,366,343 11/1994 Muller .
5,368,442 11/1994 Speer .
5,405,243 4/1995 Hurley et al. .
5,423,701 6/1995 Rodskier et al. .
5,445,497 8/1995 Seemar .
5,466,177 11/1995 Aihara et al. .
5,494,406 2/1996 Takada et al. .
5,527,154 6/1996 Drajan .
5,646,321 7/1997 Williams et al. .

VARIABLE PITCH PROPELLER APPARATUS

FIELD OF THE INVENTION

This invention relates to the field of variable pitch propellers for motor boats and more particularly, to an apparatus for adjusting the pitch of the propeller of an outboard or inboard motor so that a desired trolling speed may be attained.

BACKGROUND OF THE INVENTION

It is known that some types of fishing require that bait be presented within inches of the bottom of the body of water. Most fishermen troll to achieve this desired position. The boat is moved slowly enough to allow a given weight of tackle and bait to hang nearly vertical beneath the boat, thereby achieving the desired bait position. Trolling may be accomplished in several ways. The primary engine or motor may be shut down and a trolling motor may be used. This additional piece of equipment requires further maintenance and attention from the user as well as an additional cost. Another alternative is to attach a high drag device to the back of the boat to slow it down. The attachment of a plate or other device to produce drag lessens the maneuverability of the boat and must be removed or disabled when normal operation is desired. Removal of such a device is difficult or inconvenient to accomplish quickly while on the water. Many fishermen also resort to trolling backwards with their engine to try to achieve the appropriate speed for desired fishing. Trolling backwards increases the boats drag and if conditions are just right the presentation of bait will be as desired. However, this change in position often is not adequate enough to provide a good speed for trolling due to many factors including changing weather conditions.

It has also been known that changing the pitch of the prop allows for trolling with engines not normally capable of trolling. Some engines are prone to stalling when operated at low rpm. Decreasing the pitch of the prop allows for the motor to run at a reliable rpm while advancing the boat at a reduced speed. Many devices have been designed to decrease the pitch of the prop. The devices are complicated mechanical systems that have not been shown to be reliable, are not easily used, and often do not afford any practical means for adjustment by the user. It is important that a user be able to adjust the pitch of the prop so that different conditions may be accounted for and the needs of the user can be met for a particular size engine. If prior devices do offer adjustability it is often very difficult to actually adjust the mechanism and the reliability of the adjustment mechanism may not be good. Some devices do not provide automatic means for changing the pitch of the propeller blades. It is not practical to utilize a device that must be manipulated when the user wants to shift from a low to high speed and vice versa. Fishermen want the capability to go from a trolling speed to a high speed easily as they move around a lake.

Some previous devices have been designed to improve acceleration without the loss of top speed in large horse power motors. As speed is increased, the boat planes on the water and the blades pivot to an increased pitch position. The mechanisms are complicated and very expensive. The cost of the device cannot be justified for small and mid-range horse power engines (25 to 100 hp). The vast majority of fishermen utilize motors in the 25 to 100 hp range.

Therefore, a need remains for an apparatus for varying the pitch of a propeller of an engine which is not complex and is of a reasonable cost. It is desirable to utilize an apparatus which allows for precise, convenient adjustment by the user. It is also desirable that after the pitch is set by the user the change from low pitch to high pitch and vice versa is automatic so that the user may move from high speed to a trolling speed and back to high speed easily.

The art referred to and/or described above is not intended to constitute an admission that any patent, publication or other information referred to herein is "prior art" with respect to this invention. In addition, this section should not be construed to mean that a search has been made or that no other pertinent information as defined in 37 C.F.R. §1.56(a) exists.

SUMMARY OF THE INVENTION

The invention includes a housing having an aft portion, a blade portion and a forward portion. The blade portion has a plurality of apertures for receiving a plurality of rotatable blades journaled by bushings in the apertures. The blades, three in a preferred embodiment, each include a blade shaft and a biasing pin. The blade shaft is received by an aperture of the blade portion of the housing and is contacted by a cross pin. A tensioning ring is threaded within the aft portion of the housing and includes a plurality of apertures. The forward portion of the housing includes outside threaded aft and forward portions. A pair of stop rings (high pitch and low pitch) are threaded onto each of the forward and aft threaded portions of the forward portion of the housing and a synchronizer ring is slidably received by the forward portion of the housing and positioned between the high pitch stop ring and low pitch stop ring.

The biasing pins of each blade are received by apertures in the synchronizer ring. The synchronizer ring also includes a plurality of spring apertures for receiving one end of a spring. For each of the plurality of springs utilized, one end of the spring is connected to the synchronizer ring by attachment to the spring apertures and the other end of the spring is connected to each of the apertures of the tensioning ring to bias the blades in a low pitch position against the low pitch stop ring. Apertures in the forward portion of the housing allow for attachment of the springs to the synchronizer ring. In an alternative embodiment, one end of each of the springs is connected to the biasing pin of the blade rather than the synchronizer ring. Each blade biasing pin engages the synchronizer ring and in this manner the movement of the blades is coordinated. The biasing force of the springs is adjusted by adjusting the position of the tensioning ring with respect to the aft portion of the housing.

The hub or housing includes an adapter for receiving the prop shaft of the engine. A damper surrounds the adapter and a prop nut is tightened against a spring washer and retaining washer forcing the device against a thrust collar of an engine thereby connecting the apparatus to the engine for use. The engine drives the prop shaft to rotate thereby rotating the propeller.

In operation, the biasing force of the springs biases the blades in the low pitch position and the blades stay in this position at low rpm operation of the engine. The biasing springs engage the synchronizer ring directly or indirectly and hold all blades in this position. As the engine throttle is opened from its trolling setting, increasing thrust on the blades overcomes the biasing force of the springs and the blades pivot in unison to the high pitch position. Synchronization of blade movement is coordinated by the synchronizer ring. As the blades pivot, the biasing pins move the synchronizer ring. The blades pivot simultaneously. Because the blades are all attached to the synchronizer ring the blades are not allowed to pivot individually. The limits of the blade rotation are set by the positioning of the high pitch stop ring and low pitch stop ring. The synchronizing ring slides about the forward portion of the housing between the two stop rings and the movement of the blades is limited in this way.

A variable pitch propeller is disclosed for use with a motor, the operation of the motor creating a thrust force on the propeller, comprising a hub for attachment to the motor, the hub being generally cylindrical and having a longitudinal axis, the hub comprising a forward housing having a forward and an aft end; a blade housing connected to the forward housing and including a plurality of apertures each having a pitch axis extending radially from the longitudinal axis of the hub; and an aft housing connected to the blade housing; a plurality of blades each having a shaft and a biasing pin, each blade shaft received by an aperture of the blade housing, each blade being mounted for rotation about the pitch axis of the aperture; a high pitch stop ring adjustably connected to the forward end of the forward housing; a low pitch stop ring adjustably connected to the aft end of the forward housing; a synchronizer ring slidably received by the forward housing and positioned between the high pitch stop ring and the low pitch stop ring, the synchronizer ring having a plurality of apertures each for receiving the biasing pin of each blade; and a plurality of springs each having a first and a second end and a biasing force, the first end connected to the synchronizer ring and the second end connected to the aft housing; whereby when the thrust force on the blades overcomes the biasing force the synchronizer ring slides from the low pitch stop ring to the high pitch stop ring and the blades rotate about the pitch axis coordinated by the synchronizer ring and the rotation of the blades is limited by the positions of the high pitch stop ring and low pitch stop ring.

A variable pitch propeller is disclosed for use with a motor, the operation of the motor creating a thrust force on the propeller, comprising a hub for attachment to the motor, the hub being generally cylindrical and having a longitudinal axis, the hub comprising a forward housing having a forward threaded portion and an aft threaded portion; a blade housing connected to the forward housing and including a plurality of apertures each having a pitch axis extending radially from the longitudinal axis of the hub; and an aft housing connected to the blade housing; a plurality of blades having a shaft and a biasing pin, each blade shaft received by an aperture of the blade housing, each blade being mounted for rotation about the pitch axis of the aperture; a high pitch stop ring having internal threading and adjustably connected to the forward threaded portion of the forward housing; a low pitch stop ring having internal threading and adjustably connected to the aft threaded portion of the forward housing; a synchronizer ring slidably received by the forward housing and positioned between the high pitch stop ring and the low pitch stop ring, the synchronizer ring having a plurality of apertures each for receiving the biasing pin of each blade; a plurality of springs each having a first and a second end and a biasing force, the first end connected to the biasing pin of the blade and the second end connected to the aft housing; and tensioning means connected to the aft housing for adjusting the biasing force of the springs; whereby when the thrust force on the blades overcomes the biasing force of the springs the synchronizer ring slides form the low pitch stop ring to the high pitch stop ring and the blades rotate about the pitch axis coordinated by the synchronizer ring and limited by the positions of the high pitch stop ring and low pitch stop ring.

It is an object of this invention to provide a variable pitch apparatus which operates between two positions, a low pitch position for trolling and a high pitch position for normal operation or higher speeds. The blades of the propeller are biased in a low pitch position and are driven to the high pitch position when the thrust produced by the engine exceeds the force holding the blades in the low pitch position. The change in blade position from low pitch to high pitch is automatic. No additional or external steps must be taken by the user beyond normal operation of the engine.

It is an object of the invention to provide a device that allows the engine to run smoothly and reliably while propelling a boat very slowly for use in trolling in both forward and reverse gear. The device overcomes past problems of engine fouling and stalling due to operation at low rpm. The invention also allows the engine to operate at maximum power when desired without reducing speed which may occur with other devices.

It is yet another object of this invention to allow the user to easily adjust the low pitch and high pitch positions of the apparatus as installed. No tools are necessary. The adjustment is unlimited and the high and low speed stops are adjusted independently for additional flexibility for the user.

It is still another object of the invention to provide a device where the biasing force between high and low pitch positions may be adjusted. The biasing force may be adjusted easily with no tools. The user has control over the point at which the blades pivot from the low pitch to the high pitch position.

It is another object of this invention to provide a device which is low in cost and high in reliability. The invention is not complex in design and therefore, cost can remain low and lessen the chances of mechanical failure.

It is yet another advantage of the invention that there is direct interchangeability between the device of the invention and the stock or standard prop that comes with the engine or is normally used with the invention. Also, the invention is universal in the sense that it is designed so that it can be used with various motors by changing the adaptor to fit various engines.

These and other advantages and features which characterize the present invention are pointed out with particularity in the claims annexed hereto and forming a further part hereof. However, for a better understanding of the invention, its advantages and objects obtained by its use, reference should be made to the drawings which form a further part hereof and to the accompanying descriptive matter, wherein there is illustrated and described a preferred embodiment of the present invention.

BRIEF DESCRIPTION OF THE FIGURES

In the drawings, wherein like reference numerals represent like parts throughout the several views.

DETAILED DESCRIPTION OF THE INVENTION

While this invention may be embodied in many different forms, there are described in detail herein specific preferred embodiments of the invention. This description is an exemplification of the principles of the invention and is not intended to limit the invention to the particular embodiments illustrated.

Figure 1:
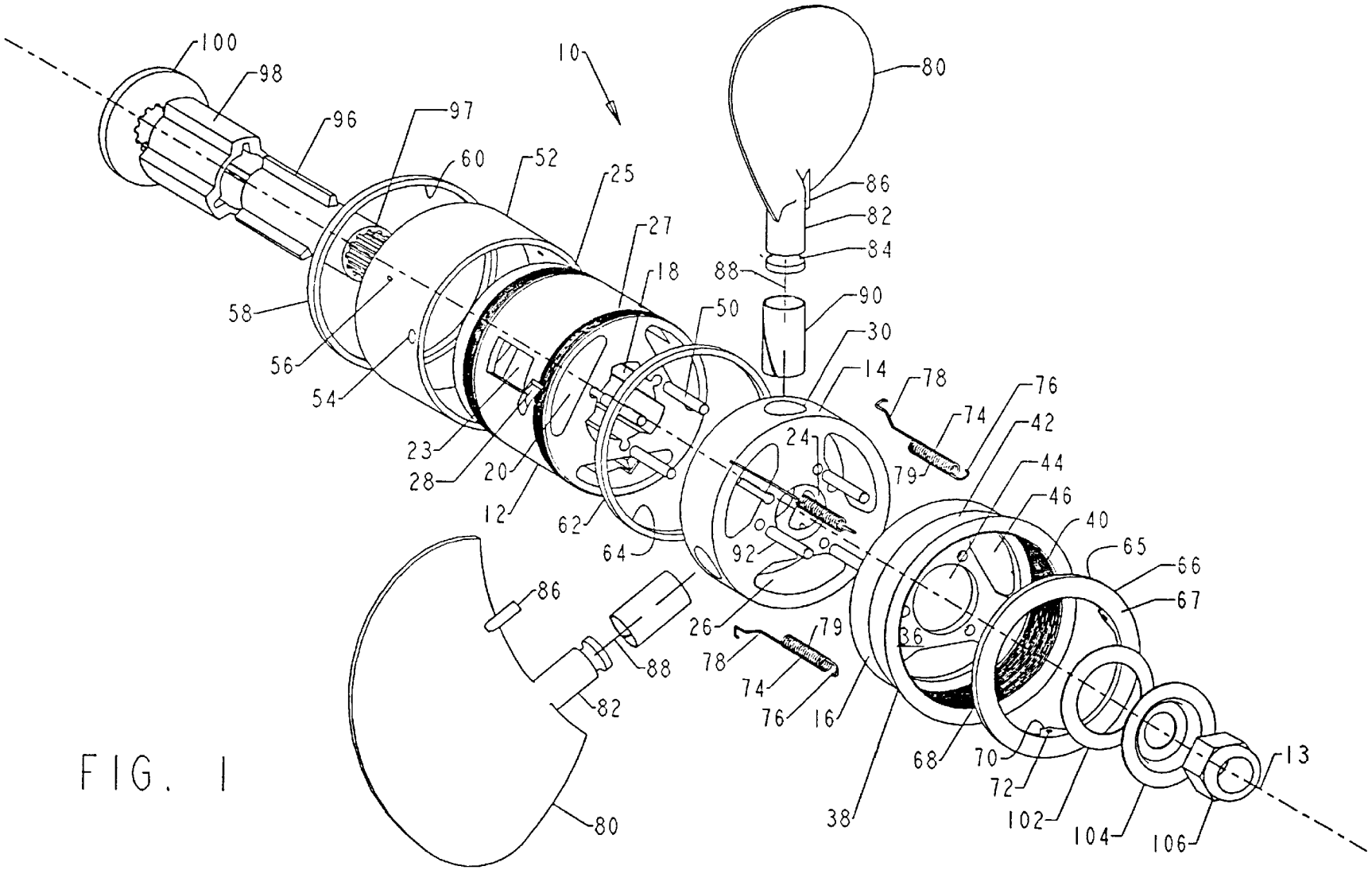
FIG. 1 illustrates an exploded perspective view of the preferred embodiment of the invention.
Figure 2:
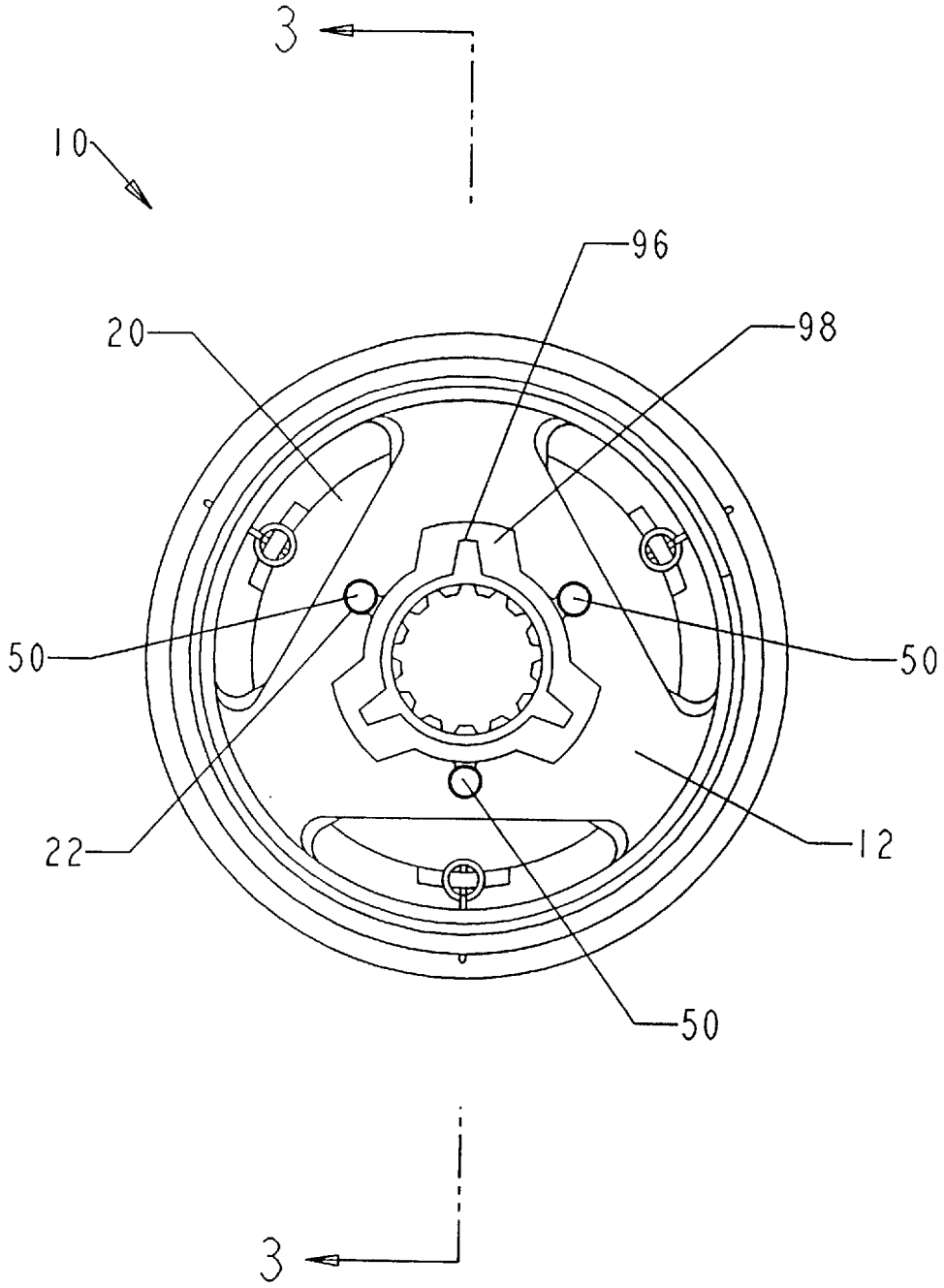
FIG. 2 illustrates a forward end elevational view of the apparatus of the invention without a thrust collar or blades.
Figure 3:
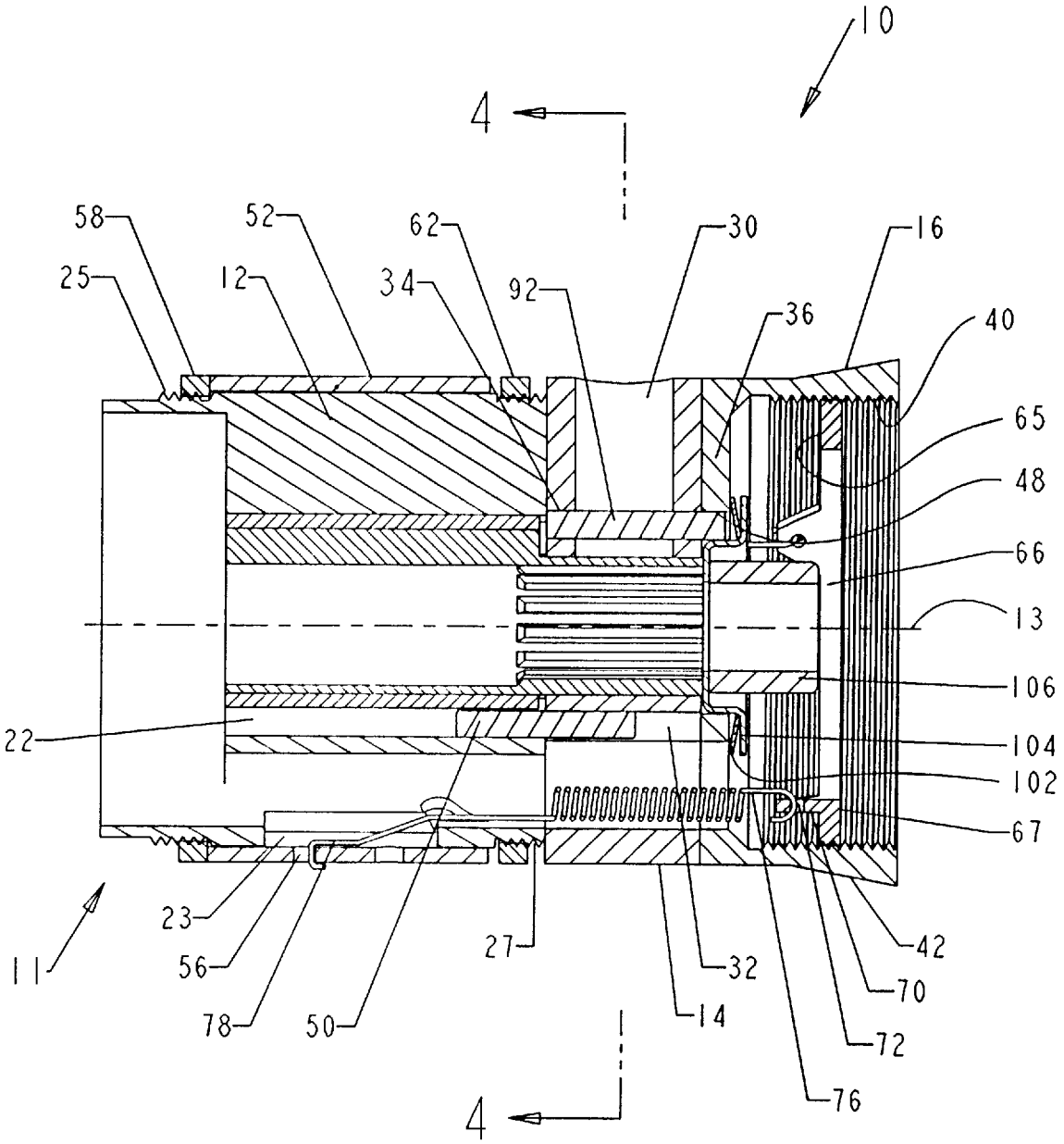
FIG. 3 illustrates a cross sectional elevational view of the apparatus of the invention taken along the lines 3—3 of FIG. 2.

Referring to FIG. 1, a preferred embodiment of the invention is shown. The apparatus 10 is designed to be connected to the drive shaft of an outboard or inboard motor for a boat (not shown). The apparatus 10 includes a housing or hub 11 made up of forward housing 12, blade housing 14 and aft housing 16 having a common longitudinal axis or axis of rotation 13 for rotation by the drive shaft of the motor when in operation. The forward housing 12 is generally cylindrical. The housing 12 includes a central bore 18 and a plurality (three in the preferred embodiment although any appropriate number maybe used) of exhaust apertures 20 arranged about the central bore 18. The forward housing 12 also includes a plurality of connecting apertures 22 for connecting the forward and blade housings 12 and 14. In the preferred embodiment, the connecting apertures 22 and the central bore 18 are connected although it should be understood that they may be separate. Referring also to FIG. 3, the forward housing 12 also includes three spring apertures 23, one of which is seen in FIGS. 1 and 3. These spring apertures 23 will be discussed further later in this description. The outer surface of the forward housing also includes a forward threaded portion 25 and an aft threaded portion 27. A plurality of grooves 28 are also cut into the housing 12 for allowing for clearance of the blade as will be described later.

Figure 4:
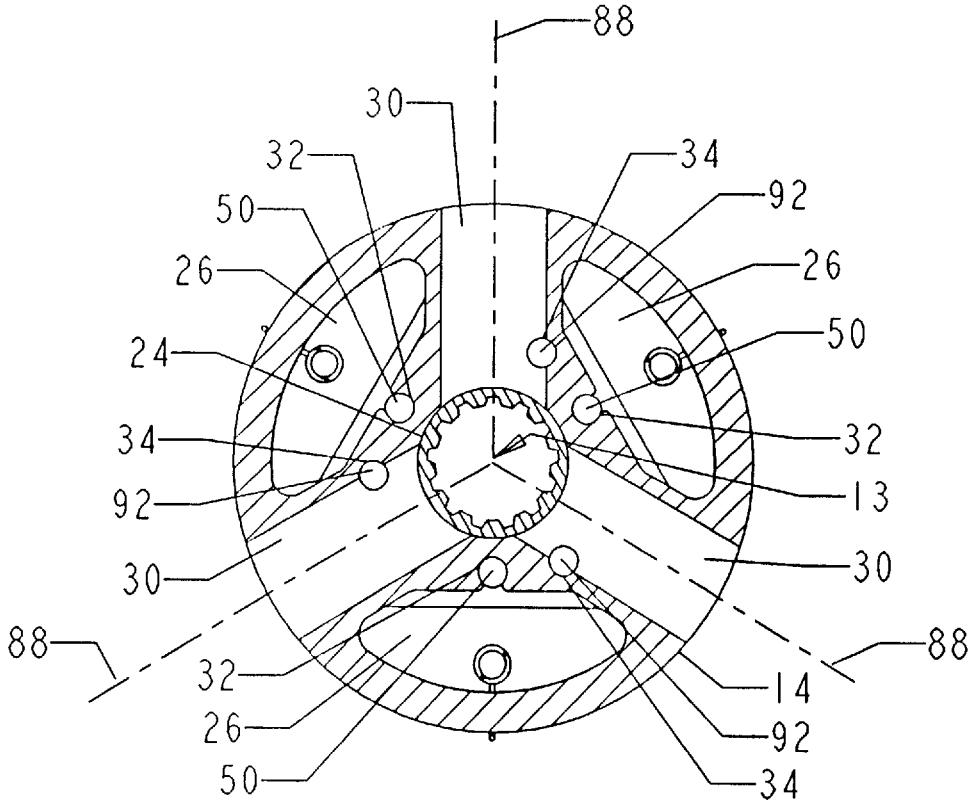
FIG. 4 illustrates a cross sectional elevational view of the apparatus of the invention taken along the lines 4—4 of FIG. 3.

Referring now to FIGS. 1 and 4, the blade housing 14 is generally cylindrical and includes a central bore 24 and a plurality of exhaust apertures 26 arranged about the central bore 24. The blade housing 14 also includes a number of blade apertures 30 each having an axis extending radially from the longitudinal axis 13. The number of blade apertures 30 is determined by the number of blades that will be used to propel the boat and in the preferred embodiment of the invention the blade housing 14 includes three blade apertures 30 spaced evenly radially about the central bore 24 with the axis of each aperture 30 approximately 120° apart. A plurality of connecting apertures 32 are located in the blade housing 14. In the preferred embodiment the connecting apertures 32 and exhaust apertures 26 are connected although it is understood that they may be separate. The blade housing 14 also includes a plurality of retaining pin or cross pin apertures 34 which will be discussed in more detail later in this description. Three retaining pin apertures are utilized in the preferred embodiment corresponding to each of the three blades used.

Figure 5:
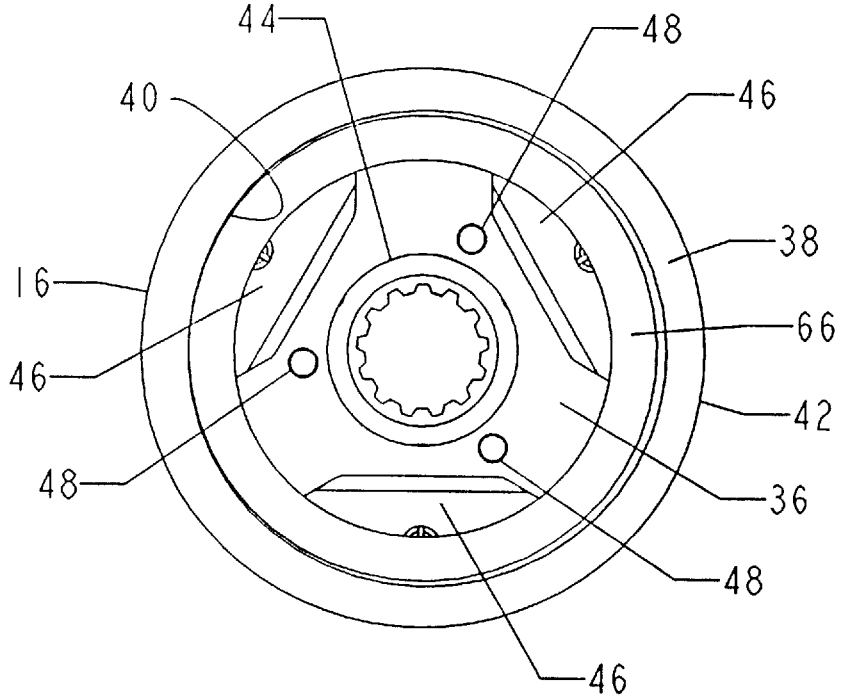
FIG. 5 illustrates an end elevational view of the aft housing of the invention.

Referring to FIGS. 1, 3, and 5, the aft housing 16 has a base 36 and connected thereto is a wall 38 having an inner side 40 and an outer side 42. In the preferred embodiment, the outer side 42 of wall 38 flares outwardly in a direction away from the base 36 and blade housing 14. Like the forward and blade housings 12 and 14, the aft housing 16 has a central bore 44 and a plurality of exhaust apertures 46 (three in the preferred embodiment) in the base 36. The base 36 also includes three cross pin apertures 48. The inside 40 of wall 38 is threaded as is shown in FIGS. 1 and 3.

In the preferred embodiment the forward 12, blade 14 and aft 16 housings are keyed together with pins to prevent rotation of the parts relative to one another. As described above, the housings 12, 14, and 16 each have common bores 18, 24, 44 with a common longitudinal axis 13. The housings 12, 14, and 16 are arranged and configured to mate such that the exhaust apertures 20, 26 and 46 of the housings are aligned. Further, the connecting apertures 22 of the forward housing 12 and the connecting apertures 32 of the blade housing 14 are aligned. The forward housing 12 is adjacent to the blade housing 14 and housing keys or pins 50 are inserted into each of the apertures 22 of the forward housing 12 and into the apertures 32 of the blade housing 14. In this manner, the forward 12 and blade 14 housings are connected and cannot rotate relative to one another.

The blade housing 14 is positioned between the aft 16 and forward 12 housings and further arranged such that the cross pin apertures 34 of the blade housing 14 are aligned with the cross pin apertures 48 of the aft housing 16. The connection of the blade housing 14 to the aft housing 16 is made by the insertion of pin 92 into the cross pin aperture 34 and cross pin aperture 48. In this manner, rotation of the housings is prevented. The cross pins 92 also connect the blades to the housing which will be discussed later in this description in the discussion of the blades.

Figure 7:
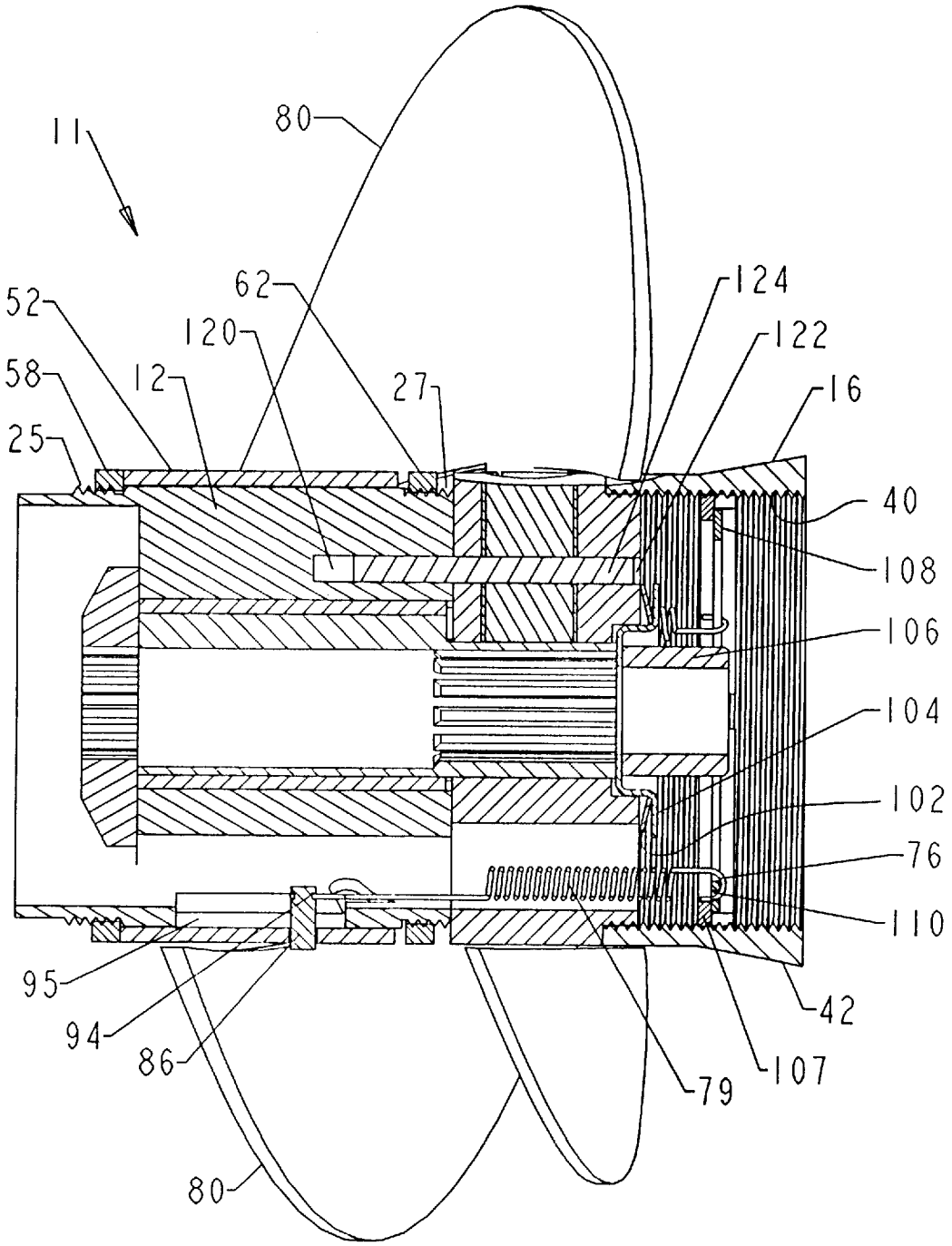
FIG. 7 illustrates a cross sectional elevational view of another embodiment of the invention.

In another embodiment of the invention, housing keys or pins 50 and the associated apertures are not utilized. Referring now to FIG. 7, an embodiment of the invention is shown where the blade retaining pins are extended in length and key the housing together. The two portions 12 and 14 of the housing 11 include apertures which are aligned. The forward housing 12 includes key apertures 120 and the blade housing 14 includes key apertures 122. The blade retaining pin 124 is extended in length so that it is received by the apertures 120 and 122 in each of the housings. The aft housing 16 is threaded onto the blade housing 14 in this embodiment.

The connection of the housing 11 will also be discussed later in relation to the description of the apparatus and the attachment to a prop shaft. It should be understood that any other means or combination including the above described configurations for connecting the housings may be utilized such as screws, bolts and other connecting devices. It is also contemplated that some or all of the forward, blade, and aft housings may be formed integrally and thus only some or no further connection means would be necessary. Any modification of the parts that would be necessary to utilize a fully or partially integral housing would be considered routine engineering to one skilled in the art.

The apparatus 10 also includes a synchronizer ring 52 which is generally circular in cross section and includes a plurality of biasing pin apertures 54 and a plurality of spring apertures 56. The synchronizer ring 52 is slidably received by the forward housing 12. The ring 52 is arranged such that the spring apertures 56 are aligned with the spring apertures 23 of the forward housing 12. The synchronizer ring 52 coordinates the movement of the blades which will be discussed later in this description.

Referring again to FIGS. 1 and 3, the apparatus 10 also includes a high pitch stop ring 58. The high pitch stop ring 58 is generally circular in cross section and has an inner surface 60 which is threaded. The high pitch stop ring 58 is threaded onto the forward threaded portion 25 of the forward housing 12. The invention also includes a low pitch stop ring 62 which is generally circular in cross section and has an inner surface 64 which is threaded. The low pitch stop ring 62 is threaded onto the aft threaded portion 27 of the forward housing 12. As is illustrated, the synchronizer ring 52 is positioned between the high pitch stop ring 58 and the low pitch stop ring 62 and slides about the forward housing 12 between the stops. The user adjusts the position of the high and low stop rings to limit the movement of the synchronizer ring as desired for the desired pitch of the blades. The rings 58 and 62 are adjusted by hand screwing and unscrewing the rings on the threaded portions 25 and 27 of the forward housing 12. No tools are needed to adjust the position of the stop rings 58 and 62 and adjustment can be done with the apparatus connected to the motor and boat. Once the rings are positioned by the user no rotation of the parts is desired. Therefore, the threads of the corresponding parts are formed to interfere such that the parts may be adjusted by hand yet there will be no relative rotation in use. Such interference is known to those skilled in the art and may be accomplished by not machining the threads of one part as deep as would normally be done, for example. The stop rings 58 and 62 can be of varying widths as desired. Varying the width of the rings or providing a number of rings of different width to the user offers more flexibility. It should also be understood that the rings may be attached to the housing by various means which offer adjustability. One such option is by clamping where each ring includes or is connected to a clamp so that the rings are adjusted by clamping and unclamping and moving the ring to the desired position.

The invention also includes a tensioning ring 66 which is generally circular in cross section and has a first end 65, a second end 67 and an outer wall 68 which is threaded. The ring 66 also includes a plurality of flanges 70 connected to the first end 65 of the ring 66. Each flange 70 includes a spring aperture 72. The tensioning ring 66 is connected to the aft housing 16. The threaded outer wall 68 of the tensioning ring 66 engages the threaded inner wall 40 of the aft housing 16. The user may position the tensioning ring 66 as desired in the threaded area 40 for precise simultaneous tensioning of the springs to be discussed later in the description. Adjustments are made by hand by the user. In order to ensure that the desired position or adjustment is maintained in use, the threads of the tensioning ring 66 and the aft housing 16 are cut such that there is enough interference between the threaded parts so that there is no movement after adjustment and rotation of the parts relative to one another is prevented. It should be understood that any attachment means other than flanges as described in the preferred embodiment, such as another ring within the tensioning ring, hooks or other known means may be utilized within the spirit of the invention. One such alternative is shown in FIG. 7. A tensioning ring 107 engages the threaded inner wall 40 of the aft housing 16. A spring ring 108 is seated within the tensioning ring 107. The spring ring 108 includes apertures 110 for the springs.

A plurality of springs 74 are utilized with the invention to bias the synchronizer ring 52 in the low pitch position at low rpm operation of a motor. The springs 74 are connected between the tensioning ring 66 and the synchronizer ring 52. Three helical wound springs 74 are used in the preferred embodiment but it should be understood that any appropriate spring or number of springs may be utilized. Each spring 74 has an aft end 76, a forward end 78 and a body 80. The aft end 76 of the spring 74 is configured to be connected to a spring aperture 72 of the tensioning ring 66 as shown in FIG. 3. In the alternative embodiment of FIG. 7 the spring 74 is connected to spring ring 108 through apertures 110. The spring body 80 is positioned and arranged in the exhaust apertures of the housings 12, 14, and 16 in the preferred embodiment. The forward end 78 of the spring 74 is configured to be connected to the synchronizer ring 52. Each of the spring apertures 23 of the forward housing 12 receives a forward end of the spring 78. The forward end 78 continues through the spring aperture 23 and is configured and arranged to be connected to the spring aperture 56 of the synchronizer ring 52. The forward end 78 and aft end 76 are hooked in the preferred embodiment but it should be understood that any appropriate configuration may be used. Either or both ends of the spring 74 may be connected to the tensioning ring 66 and synchronizer ring 52 by any conventional means. For example, a connector or clip may be attached to the spring and the clip may then be attached to the appropriate part through the appropriate apertures. A screw arrangement or soldering may be used to attach the spring to the invention or to the connector, for example. Any conventional or known attachment means is within the spirit of the invention.

Figure 6:
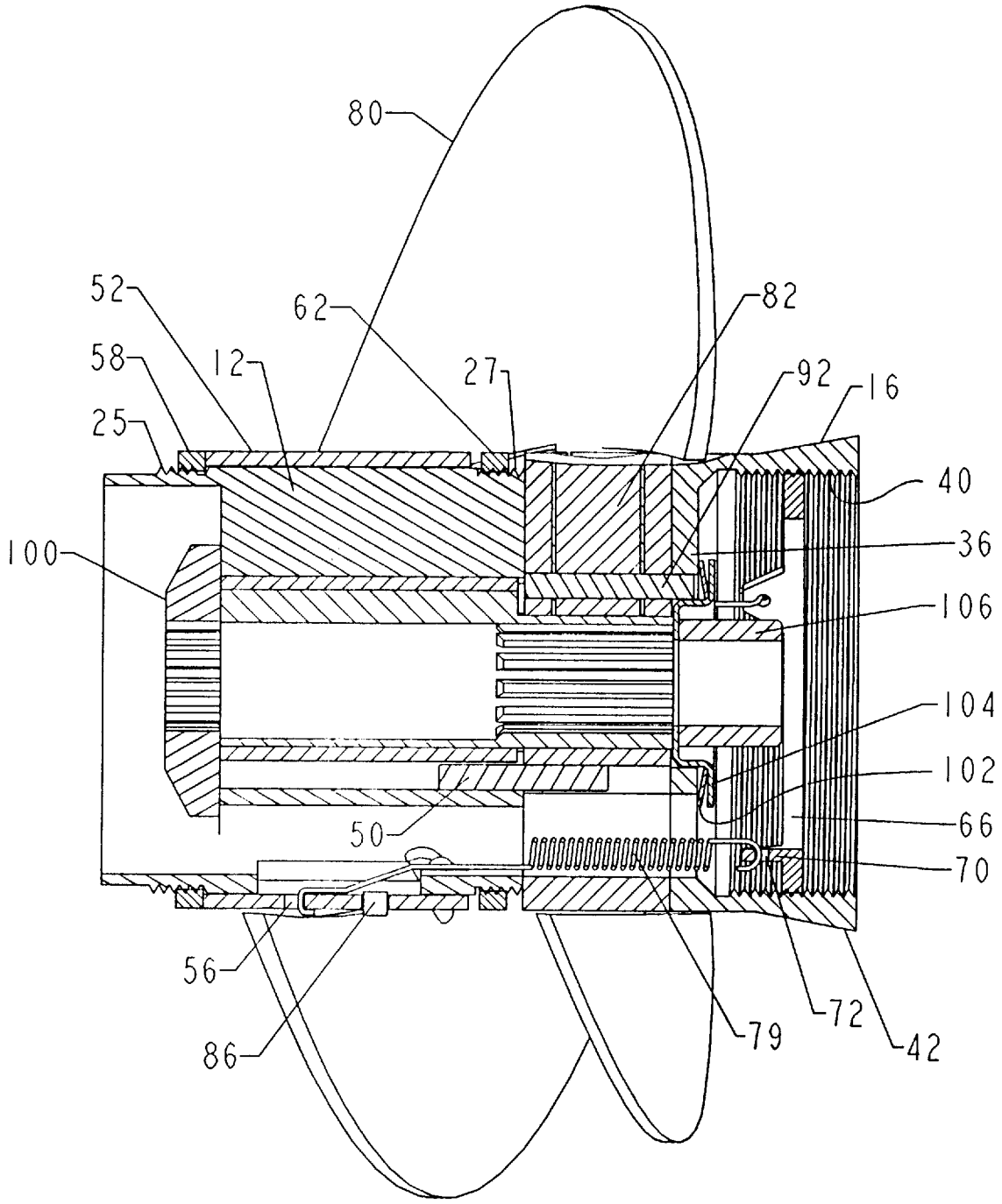
FIG. 6 illustrates a cross sectional view of the invention showing a blade received by the housing.

Referring now to FIGS. 1, 3 and 6, the blades 80 of the device 10 will be discussed. The blades 80 include a blade shaft 82 having a groove 84 and a biasing pin 86. The blade 80 rotates about an axis 88. The blade 80 is seated in a bushing 90 and received by aperture 30 of the blade housing 14. A plurality of cross pins 92 connect the blades 80 to the blade housing 14 and also connect the blade housing 14 to the aft housing 16. The cross pins 92 are received by the cross pin apertures 48 of the aft housing 16 and the cross pin apertures 34 of the blade housing 14. The cross pins 92 engage the groove 84 of the blade shaft 82 to hold the blade in the housing 14 but allow the blade to pivot about the axis 88. The biasing pin 86 of the blade 80 is received by biasing pin apertures 54 of the synchronizer ring 52. The biasing pin 86 is aligned with the groove 28 of the forward housing 12 permitting rotation. In this manner, the blades and bushings are easily replaced by the user, if necessary. The cross pins are located to facilitate the changing of the blades or bushings. The user may change the blades on the water if necessary as the only tool needed is a wrench to remove the prop nut. Engagement of the biasing pins 86 to the synchronizer ring 52 coordinates the movement of the blades 80. All blades are moved simultaneously. It should be understood that the invention may be configured such that no groove 28 is necessary and the blade biasing pin 86 may be cooperatively connected by any known means.

It should also be understood that the springs 74 may be connected to the biasing pins 86 directly as is shown in the embodiment of FIG. 7. The pin 86 of the blade is configured to pass through aperture 54 of the synchronizing ring 52 and into an aperture 95 of the forward housing which is aligned with aperture 54 where the spring 74 is attached to the pin 86. The forward end 78 of the spring 74 is connected to a groove 94 cut into the biasing pin 86. The end 78 of the spring 74 may be hooked as shown to connect to the groove 94 or may be fastened by any suitable means such as a screw arrangement or soldering, for example.

An adapter 96 and damper 98, known to those skilled in the art, are configured and arranged to fit within the cores 18, 24, and 44 of the housing 11 to be connected to the prop shaft of a motor (not shown). The adaptor 96 can be designed so that the internal splines 97 shear at impact with an object, lake bottom or foreign body. Damage is limited to the adaptor, which can be easily replaced, and to any blades which may be damaged. The adaptor can be made of a plastic that shears at a predetermined load. The damper 98 provides vibration absorbance when shifting in and out of gear when operating the motor. The damper 98 also prevents debris in the water or from the bottom of the lake from entering the apparatus to prevent damage to the motor's drive train or the propeller housing. A thrust collar 100, usually supplied with the motor and known to those skilled in the art, is placed on the prop shaft of a motor. The prop shaft of the motor receives the adaptor 96 and damper 98 which are seated against the thrust collar 100. A spring washer 102, retaining washer 104 and prop nut 106 are used to load the assembly against the thrust collar and secure the invention to the motor. The prop nut 106 in conjunction with the washers 102 and 104 force the assembly against the thrust collar 100 and hold the housings 12, 14, and 16 in a secured, mated position on the motor. The keys and pins described above prevent rotation of the parts relative to one another. The washers 102 and 104 are of the type known to those skilled in the art and it should be understood that any type or number of washers may be used In the preferred embodiment of the invention, the forward and blade housing are made of aluminum. Most of the remaining parts are made of an appropriate rigid plastic. Of course any suitable materials may be used such as stainless steel, plastic, or other metals. The springs 74 are made of stainless steel in the preferred embodiment. The damper is made of an appropriate elastomeric material and the adaptor is made of a rigid plastic. Of course, it should be understood that any appropriate materials or combination of materials may be used for the various parts of the invention.

For operation, the device is assembled and connected to the prop shaft of a motor as was described above. In operation, the user adjusts the position of the high pitch ring 58 on the forward threaded portion 25 of the forward housing 12 and adjusts the position of the low pitch ring 62 on the aft threaded portion 27 of the forward housing 12 by hand. The user adjusts the position of the rings 58 and 62 based on the desired pitch of the blades for trolling. The rotation or pitch of the blades 80 is limited by the movement of the synchronization ring 52 between the stops 58 and 62. The low pitch ring is set based on the desired trolling speed of the user. The high pitch ring is set based on the motor characteristics. Known methods including trial and error and use of a tachometer are used for choosing the desired settings.

The user also adjusts the position of the tensioning ring 66 in the aft housing 16 as desired. The position of the ring 66 is changed by threading in and out of the aft housing. In an alternative embodiment, the position of the ring 108 is adjusted by threading the ring 107 in and out. The tensioning ring 66 allows for adjustment of the tension on the springs 74 to bias the blades 80 in the low pitch position. The greater the tension on the springs 74, the higher the rpm of the motor are reached and necessary before the force of the water on the blades overcomes the force of the springs causing the blades to pivot between the low and high pitch positions. The nominal tension on each of the springs 74 is equal, as identical springs are used in the preferred embodiment. Therefore, adjustment of the springs is equal and simultaneous. Of course, if desired, springs of different tensions could be used. Adjustment of the springs would still be simultaneous. After the desired adjustments have been made the device 10 may be used for desired trolling.

The biasing force of the springs 74 biases the blades 80 in the low pitch position. In other words, the springs 74 bias the synchronizer ring 52 against the low pitch stop ring 62 and because the biasing pins 86 are cooperatively connected to the synchronizer ring 52 the blade position is controlled by movement of the ring 52 and limited by the position of the stop rings 58 and 62. As the engine is operated at relatively low rpm the thrust force on the blades 80 is less than the spring biasing force of the springs and the pitch of the blades 80 is lower which allows for trolling. As the engine throttle is opened trolling speed is maintained until the increasing thrust on the blades 80 is greater than the spring force. The blades are designed so that the net thrust force on the blade falls between the pivot axis 88 of the blade and the leading edge of the blade as it turns forward. At the point when the force on the blades 80 is greater than the spring force, the synchronizer ring 52 is forced to slide about the forward housing 12 toward the high pitch stop ring 58. As the synchronizer ring 52 moves, the blades 80 pivot from the low pitch position to the high pitch position because of the cooperative connection of the biasing pins 86 to the synchronizer ring 66. The blades 80 rotate about axis 88 in the apertures 30 of the housing 14. Rotation or pivoting of the blades 80 is limited by the position of the high pitch stop ring 58 and is synchronized by the ring 52. The blades 80 cannot move independently but move simultaneously for smooth transformation from low pitch to high pitch operation. The synchronizer ring 52 stays in this high pitch position until the engine throttle is sufficiently closed so that the biasing force of the springs 74 is greater than the force on the blades 80. The blades 80 then pivot to the low pitch position when the synchronizer ring 52 slides about the forward housing 12 from stop 58 to stop 62. The rotation of the blades 80 from high pitch to low pitch is limited by the position of the low pitch stop ring 58.

The operation of the apparatus is essentially the same when the spring 74 is connected to the biasing pin 86 of the blade 80 directly, as shown in FIG. 7. When the spring force is overcome by the force on the blades 80 the connection of the biasing pin 86 to the synchronizer ring 52 causes the ring 52 to move between the stops 58 and 62 described above.

The above Examples and disclosure are intended to be illustrative and not exhaustive. These examples and description will suggest many variations and alternatives to one of ordinary skill in this art. All these alternatives and variations are intended to be included within the scope of the attached claims. Those familiar with the art may recognize other equivalents to the specific embodiments described herein which equivalents are also intended to be encompassed by the claims attached hereto.

What is claimed is:

1. A variable pitch propeller for use with a motor, the operation of the motor creating a thrust, comprising:

(a) a hub for attachment to the motor, the hub being generally cylindrical and having a longitudinal axis, a plurality of apertures each having a pitch axis extending radially from the longitudinal axis, a forward portion and an aft portion, the forward portion including a forward end and an aft end;

(b) a plurality of blades each having a shaft and a biasing pin, each blade shaft received by an aperture of the hub and mounted for rotation about the pitch axis of the aperture;

(c) a high pitch stop adjustably connected to the forward end of the forward portion of the hub;

(d) a low pitch stop adjustably connected to the aft end of the forward portion of the hub;

(e) a synchronizer ring slidably received by the forward portion and positioned between the high pitch stop and the low pitch stop, the synchronizer ring having a plurality of apertures each for receiving the biasing pin of each blade;

(f) a plurality of springs each having a first and a second end and a biasing force, the first end connected to the synchronizer ring and the second end connected to the aft portion of the hub; whereby when the thrust force on the blades overcomes the biasing force the synchronizer ring slides from the low pitch stop to the high pitch stop and the blades rotate about the pitch axis coordinated by the synchronizer ring and limited by the stops.

2. The apparatus of claim 1 further comprising tensioning means for adjusting the biasing force of the springs simultaneously, the tensioning means cooperatively connected to the hub and the springs.

3. The apparatus of claim 2 wherein the aft portion of the hub includes an inner threaded portion and the tensioning means comprises a tensioning ring having an outer threaded area, the tensioning ring received by the inner threaded portion of the aft portion of the hub.

4. The apparatus of claim 2 wherein the aft portion of the hub includes an inner threaded portion and the tensioning means comprises a tensioning ring having an outer threaded area and a spring ring received by the tensioning ring, the tensioning ring received by the inner threaded portion if the aft portion and the second end of the spring is connected to the spring ring.

5. The apparatus of claim 1 wherein the forward portion of the hub includes a forward threaded portion proximate the forward end and an aft threaded portion proximate the aft end, the high pitch stop ring includes internal threading, the low pitch stop ring includes internal threading and the high pitch stop ring is threaded onto the forward threaded portion and the low pitch stop ring is threaded onto the aft threaded portion.

6. A variable pitch propeller for use with a motor, the operation of the motor creating a thrust, comprising:

(a) a hub for attachment to the motor, the hub being generally cylindrical and having a longitudinal axis, a plurality of apertures each having a pitch axis extending radially from the longitudinal axis, a forward portion and an aft portion, the forward portion including a forward end and an aft end;

(b) a plurality of blades each having a shaft and a biasing pin, each blade shaft received by an aperture of the hub and mounted for rotation about the pitch axis of the aperture;

(c) a high pitch stop adjustably connected to the forward end of the forward portion of the hub;

(d) a low pitch stop adjustably connected to the aft end of the forward portion of the hub;

(e) a synchronizer ring slidably received by the forward portion and positioned between the high pitch stop and the low pitch stop, the synchronizer ring having a plurality of apertures each for receiving the biasing pin of each blade;

(f) a plurality of springs each having a first and a second end and a biasing force, the first end connected to the biasing pin of the blade and the second end connected to the aft portion of the hub; whereby when the thrust force on the blades overcomes the biasing force the synchronizer ring slides from the low pitch stop to the high pitch stop and the blades rotate about the pitch axis coordinated by the synchronizer ring and limited by the stops.

7. The apparatus of claim 6 further comprising tensioning means for adjusting the biasing force of the springs simultaneously, the tensioning means cooperatively connected to the hub and the springs.

8. The apparatus of claim 7 wherein the aft portion of the hub includes an inner threaded portion and the tensioning means comprises a tensioning ring having an outer threaded area, the tensioning ring received by the inner threaded portion of the aft portion of the hub.

9. The apparatus of claim 7 wherein the aft portion of the hub includes an inner threaded portion and the tensioning means comprises a tensioning ring having an outer threaded area and a spring ring received by the tensioning ring, the tensioning ring received by the inner threaded portion if the aft portion and the second end of the spring is connected to the spring ring.

10. The apparatus of claim 6 wherein the forward portion of the hub includes a forward threaded portion proximate the forward end and an aft threaded portion proximate the aft end, the high pitch stop ring includes internal threading, the low pitch stop ring includes internal threading and the high pitch stop ring is threaded onto the forward threaded portion and the low pitch stop ring is threaded onto the aft threaded portion.

11. A variable pitch propeller for use with a motor, the operation of the motor creating a thrust force on the propeller, comprising:

(a) a hub for attachment to the motor, the hub being generally cylindrical and having a longitudinal axis, the hub comprising:

(i) a forward housing having a forward and an aft end;

(ii) a blade housing connected to the forward housing and including a plurality of apertures each having a pitch axis extending radially from the longitudinal axis of the hub; and (iii) an aft housing connected to the blade housing;

(b) a plurality of blades each having a shaft and a biasing pin, each blade shaft received by an aperture of the blade housing, each blade being mounted for rotation about the pitch axis of the aperture;

(c) a high pitch stop ring adjustably connected to the forward end of the forward housing;

(d) a low pitch stop ring adjustably connected to the aft end of the forward housing;

(e) a synchronizer ring slidably received by the forward housing and positioned between the high pitch stop ring and the low pitch stop ring, the synchronizer ring having a plurality of apertures each for receiving the biasing pin of each blade; and (f) a plurality of springs each having a first and a second end and a biasing force, the first end connected to the synchronizer ring and the second end connected to the aft housing; whereby when the thrust force on the blades overcomes the biasing force the synchronizer ring slides from the low pitch stop ring to the high pitch stop ring and the blades rotate about the pitch axis coordinated by the synchronizer ring and the rotation of the blades is limited by the positions of the high pitch stop ring and low pitch stop ring.

12. The apparatus of claim 11 further comprising tensioning means connected to the aft housing for adjusting the biasing force in the springs.

13. The apparatus of claim 12 wherein the aft housing includes an inner threaded portion and the tensioning means comprises a tensioning ring having an outer threaded area, the tensioning ring received by the inner threaded portion of the aft housing and the second end of the spring is connected to the tensioning ring.

14. The apparatus of claim 12 wherein the aft housing includes an inner threaded portion and the tensioning means comprises a tensioning ring having an outer threaded area and a spring ring received by the tensioning ring, the tensioning ring received by the inner threaded portion if the aft housing and the second end of the spring is connected to the spring ring.

15. The apparatus of claim 11 wherein the forward housing includes a forward threaded portion proximate the forward end and an aft threaded portion proximate the aft end, the high pitch stop ring includes internal threading, the low pitch stop ring includes internal threading and the high pitch stop ring is threaded onto the forward threaded portion and the low pitch stop ring is threaded onto the aft threaded portion.

16. A variable pitch propeller for use with a motor, the operation of the motor creating a thrust force on the propeller, comprising:

(a) a hub for attachment to the motor, the hub being generally cylindrical and having a longitudinal axis, the hub comprising:

(i) a forward housing having a forward threaded portion and an aft threaded portion;

(ii) a blade housing connected to the forward housing and including a plurality of apertures each having a pitch axis extending radially from the longitudinal axis of the hub; and (iii) an aft housing connected to the blade housing;

(b) a plurality of blades having a shaft and a biasing pin, each blade shaft received by an aperture of the blade housing, each blade being mounted for rotation about the pitch axis of the aperture;

(c) a high pitch stop ring having internal threading and adjustably connected to the forward threaded portion of the forward housing;

(d) a low pitch stop ring having internal threading and adjustably connected to the aft threaded portion of the forward housing;

(e) a synchronizer ring slidably received by the forward housing and positioned between the high pitch stop ring and the low pitch stop ring, the synchronizer ring having a plurality of apertures each for receiving the biasing pin of each blade;

(f) a plurality of springs each having a first and a second end and a biasing force, the first end connected to the synchronizer ring and the second end connected to the aft housing; and (g) tensioning means connected to the aft housing for adjusting the biasing force of the springs; whereby when the thrust force on the blades overcomes the biasing force of the springs the synchronizer ring slides form the low pitch stop ring to the high pitch stop ring and the blades rotate about the pitch axis coordinated by the synchronizer ring and limited by the positions of the high pitch stop ring and low pitch stop ring.

17. The apparatus of claim 16 wherein the aft housing includes an inner threaded portion and the tensioning means comprises a tensioning ring having an outer threaded area, the tensioning ring received by the inner threaded portion of the aft housing and the second end of the spring is connected to the tensioning ring.

18. The apparatus of claim 16 wherein the aft housing includes an inner threaded portion and the tensioning means comprises a tensioning ring having an outer threaded area and a spring ring received by the tensioning ring, the tensioning ring received by the inner threaded portion if the aft housing and the second end of the spring is connected to the spring ring.

19. A variable pitch propeller for use with a motor, the operation of the motor creating a thrust force on the propeller, comprising:

(a) a hub for attachment to the motor, the hub being generally cylindrical and having a longitudinal axis, the hub comprising:

(i) a forward housing having a forward threaded portion and an aft threaded portion;

(ii) a blade housing connected to the forward housing and including a plurality of apertures each having a pitch axis extending radially from the longitudinal axis of the hub; and (iii) an aft housing connected to the blade housing;

(b) a plurality of blades having a shaft and a biasing pin, each blade shaft received by an aperture of the blade housing, each blade being mounted for rotation about the pitch axis of the aperture;

(c) a high pitch stop ring having internal threading and adjustably connected to the forward threaded portion of the forward housing;

(d) a low pitch stop ring having internal threading and adjustably connected to the aft threaded portion of the forward housing;

(e) a synchronizer ring slidably received by the forward housing and positioned between the high pitch stop ring and the low pitch stop ring, the synchronizer ring having a plurality of apertures each for receiving the biasing pin of each blade;

(f) a plurality of springs each having a first and a second end and a biasing force, the first end connected to the biasing pin of the blade and the second end connected to the aft housing; and (g) tensioning means connected to the aft housing for adjusting the biasing force of the springs; whereby when the thrust force on the blades overcomes the biasing force of the springs the synchronizer ring slides form the low pitch stop ring to the high pitch stop ring and the blades rotate about the pitch axis coordinated by the synchronizer ring and limited by the positions of the high pitch stop ring and low pitch stop ring.

20. The apparatus of claim 19 wherein the aft housing includes an inner threaded portion and the tensioning means comprises a tensioning ring having an outer threaded area, the tensioning ring received by the inner threaded portion of the aft housing and the second end of the spring is connected to the tensioning ring.

21. The apparatus of claim 19 wherein the aft housing includes an inner threaded portion and the tensioning means comprises a tensioning ring having an outer threaded area and a spring ring received by the tensioning ring, the tensioning ring received by the inner threaded portion if the aft housing and the second end of the spring is connected to the spring ring.

* * * * *

UNITED STATES PATENT AND TRADEMARK OFFICE
CERTIFICATE OF CORRECTION

PATENT NO. : 5,810,561

DATED : September 22, 1998

INVENTOR(S) : Thomas Cossette

It is certified that error appears in the above-identified patent and that said Letters Patent is hereby corrected as shown below:

Col. 7, line 58, delete "80" and insert -- 79 --;

Col. 7, line 63, delete "80" and insert - 79 --.

Signed and Sealed this

Twenty-third Day of February, 1999

*Attest:*

*Attesting Officer*

Q. TODD DICKINSON

*Acting Commissioner of Patents and Trademarks*